US005910701A

United States Patent [19]

Takemura

[11] Patent Number: 5,910,701

[45] Date of Patent: Jun. 8, 1999

[54] FIELD-EMISSION COLD CATHODE AND MANUFACTURING METHOD FOR SAME

[75] Inventor: Hisashi Takemura, Tokyo, Japan

[73] Assignee: NEC Corporation, Japan

[21] Appl. No.: 09/019,469

[22] Filed: Feb. 5, 1998

[30] Foreign Application Priority Data

Feb. 10, 1997 [JP] Japan ..... 9-026767

[51] Int. Cl.[6] ..... H01J 1/30

[52] U.S. Cl. ..... 313/309; 313/309; 313/336; 313/496; 445/24; 445/25; 445/27; 257/10; 438/20

[58] Field of Search ..... 257/10, 11; 313/306, 313/308, 309, 336, 496; 445/24, 25, 27; 438/20

[56] References Cited

U.S. PATENT DOCUMENTS 5,475,280 12/1995 Jones et al. ..... 313/309

5,786,656 7/1998 Hasegawa et al. ..... 313/308

*Primary Examiner*—Olik Chaudhuri
*Assistant Examiner*—William David Coleman
*Attorney, Agent, or Firm*—Hayes, Soloway, Hennessey, Grossman & Hage, P.C.

[57] ABSTRACT

A field-emission cold cathode having emitters 9 formed on silicon substrate 1, and a gate electrode film 7 formed on insulation film 6 and having openings over the emitters, further includes trenches 3 formed in silicon substrate 1, a plurality of emitters formed on regions surrounded by trenches 3, and n-type regions 5 formed on the silicon substrate directly below the emitters. Breakdowns caused by field concentrations brought about by the spread of current directly below the emitters can thus be prevented, and thus the emitter pitch within regions surrounded by trenches can be determined at will. When high voltage is impressed due to a discharge, the resistance connected to the emitters prevents the flow of large currents to the emitters and the occurrence of short-circuit damage.

7 Claims, 11 Drawing Sheets

FIELD-EMISSION COLD CATHODE AND MANUFACTURING METHOD FOR SAME

BACKGROUND OF THE INVENTION

1. Field of the Invention

The present invention relates to a field-emission cold cathode and its method of manufacture, and particularly to field-emission cold cathode having a current-control element connected to emitters, and a method of manufacturing such a field-emission cold cathode.

2. Description of the Related Art

A field-emission cold cathode is an element having acute cone-shaped emitters and a gate electrode formed in proximity to the emitters and provided with openings on the submicron order, whereby the field-emission cold cathode focuses a high electric field at the tips of the emitters and emits electrons from the emitter tips in a vacuum. However, because emitters and gate in such an element are in extremely close proximity, a discharge may occur under the influence of, for example, residual gas during operation. As a result, a high current may flow to an emitter, causing melting of the emitter and short-circuiting between the emitter and gate, and as a consequence, breakdown of the element.

As a countermeasure to such problems, cold cathode elements have been developed in which a resistance layer is formed in series with the emitters so as to prevent melting and damage to emitters by controlling the current during a discharge. As one method of forming such a resistance layer, a simple method has been proposed in which a high-resistance region is formed in one portion of the cone-shaped emitter. However, because a potential difference of, for example, 100 V or more is applied between the emitter and gate, this construction results in the build-up of a voltage of 100 V or more across the high-resistance layer when a discharge causes a short-circuit to occur between the emitter and gate. In such a case, a high electric field produced in the high-resistance region causes field breakdown of the silicon film which forms the high-resistance region, or causes an avalanche effect in the high-resistance region, thereby producing flow of a large current and thus giving rise to a possible melt-breakdown of the emitter or gate. Constructions have therefore been reported in which the resistance length is lengthened such that a high field may not build up in the resistances layer. As an example, U.S. Pat. No. 5,475,280 discloses a method of lengthening the emitter cones.

The construction of such a field-emission cold cathode is shown in FIG. 1. Referring to FIG. 1, acute emitter 9 is formed in a pen shape on silicon substrate 1 with an interposed resistance layer 11, insulation layer 61 and gate electrode film 7 being formed so as to enclose emitter 9 and resistance layer 11. Forming the lower region under cone-shaped emitter 9 in a long pen shape and forming resistance layer 11 in this region enables to determine the effective length of resistance at substantially desired value. Thus, the resistance length can be set such that the voltage applied across the resistance layer may not exceed the breakdown field intensity or avalanche field intensity of silicon even in case that a high voltage builds up at the emitter tip and a consequent rise of a voltage takes place between both ends of the resistance layer when discharge or the like occurs.

This prior-art example is a method of forming resistance in the lower portion of an emitter, but other methods exist in which a resistance layer is formed separate from the emitter. FIG. 2 shows an example of the preceding technology (the technology preceding the present invention) in which emitters 9 are formed on silicon substrate 1 with insulator film 6 and gate electrode film 7 enclosing emitters 9. Trenches 3 are formed between emitters 9 to separate silicon substrate 1 into regions directly underlying each emitter. Trenches 3 are buried with insulative buried film 4. FIG. 3 shows a plan view of the cold cathode element of FIG. 2. As shown in the figure, by separating silicon substrate 1 into regions directly underlying each of emitters 9 using trenches 3, the regions of silicon substrate 1 surrounded by trenches 3 function as resistance layers connected to the corresponding emitters 9. By shortening the distance between emitters 9 and trenches 3 to form trenches at positions such that current flowing from emitters 9 may not spread, the resistance value of resistance regions enclosed by the trenches can be made uniform in the direction of thickness (depth)

This allows preventing local field to concentrate, and thereby an element with a high withstand-voltage resistance to be produced.

As explained hereinabove, forming resistance layers, having a width such that current does not spread, in series to each emitter and setting the resistance length such that field breakdown or avalanche breakdown does not occur enables both limit on the value of the current that will flow through the emitters as well as prevention of breakdown of the emitter caused by discharge. As an example, when a gate voltage is 100 V, the depth of the trenches (resistance length) must be at least 10 $\mu$m to limit field intensity to $10^5$ V/cm or less to prevent avalanche breakdown.

A first drawback of the field-emission cold cathode of the above-described prior art is that formation of a long resistance layer in the lower portion of each emitter 9 as described in the first prior-art example results in a higher aspect ratio of emitters, and this makes downsizing of the element difficult. In other words, reducing the size of the emitters while maintaining a fixed aspect ratio means reducing the diameter of the emitters. On the other hand, keeping the diameter of the emitters at a constant while increasing the resistance length to 10 $\mu$m or more to increase withstand-voltage inevitably increases the aspect ratio of the emitters. Either case causes a reduction in yield due to, for example, broken emitters when forming the emitters, and imposes a limit on miniaturization of the element. The same drawback also applies in the above-described preceding technology when the distance margin between the trenches and each emitter is reduced to bring about miniaturization. Moreover, since the width of the resistance regions underlying emitters (substrate portions demarcated by trenches 3) is decreased, an increase in resistance as well as a build-up of voltage during normal operation is caused.

As for a second drawback, in a method in which emitters are formed on a substrate surrounded by trenches as in the example of the preceding technology above, increase in the distance between emitters and trenches results in effectively all voltage applied across the base and emitter being placed locally in the contact region between the emitter and the substrate that directly underlies emitters when discharge occurs. This brings about field breakdown or avalanche breakdown. The reason for this local application of voltage is that a great distance between emitters and trenches causes current flowing from an emitter to spread radially outwards from the contact portion. The resistance for this radially spreading current is extremely high directly below an emitter (in the vicinity of the contact portion) and falls precipitously with increasing distance from the contact portion. As a result, essentially all of the voltage impressed between base and emitter is impressed to the region directly underlying this emitter when discharge occurs between base and emitter. In the following description, current spreading outwards from the emitter is referred to as spread current, and resistance that acts against this spread current is referred to as spread resistance.

Here, if the specific resistance of silicon substrate 1 is ρ, and if, for the sake of simplifying the discussion, the contact surface between the emitter and substrate is assumed to be a point p, then the current spreads out spherically within substrate 1 with point p as the current source, provided that ρ=constant. Accordingly, the resistance of the hemispherical shell demarcated by the concentric spheres of radius r and radius (r+δr) that take point p as center, i.e., the spread resistance δR(r) at radius r is:

$$\delta R(r)=\rho.\delta r/(2\pi r^2) \quad (1)$$

As a result, the total spread resistance of the current flowing from one emitter is obtained by integrating equation (1) with respect to r for the position of-trench 3 taken as a boundary condition. As can be seen from equation (1), the spread resistance is inversely proportional to the square of radius r, and spread resistance is therefore extremely high compared to other regions in the case that radius r is small, i.e., directly below an emitter. As a result, the spread resistance directly below an emitter effectively accounts for all spread resistance.

If the distance between emitters and trenches is increased to avoid discharge, the surface of a substrate region surrounded by trenches unavoidably enlarges beyond the emitter base surface. In such a case, the current which flows from the emitter radially spreads so far as the trenches. The current, after arriving at the trenches, flows in the direction of the depth of the substrate 1 as a linear flow.

Accordingly, the current experiences two kinds of resistance, i.e., spread resistance and linear resistance.

Of these, the spread resistance which associates with the substrate region directly below emitters is short in length, while major part of the voltage applied between the emitter and gate is placed in the spread resistance when discharge takes place. Consequently, the electric field of the region across which current spreads is relatively high. As a result, the spread resistance directly below emitters effectively becomes responsible for the principal cause of field breakdown, thereby raising the possibility of problems of reliability such as deterioration of withstand-voltage.

Equation (1) is based on the very rough approximation that the contact surface between an emitter and silicon substrate 1 is regarded as a point, and a quantitative inference therefore cannot be drawn based on this equation. However, actually measured values are as follows:

In a case in which an emitter is formed with a distance margin of 1 μm from trenches on a silicon substrate having a specific resistance of, for example, 5 Ωcm, the resistance of a region of the spread current exhibits a saturation tendency after spreading across a distance of approximately 0.2 μm to 0.5 μm, the resistance here being on the order of 50 kΩ. When a voltage of 100 V is applied between the gate and emitter in a case in which the resistance of a substrate region surrounded by trenches 10 μm in depth is 50 kΩ, the voltage applied to the resistance in the interior of the trenches (this resistance refers to the resistance of the region of the substrate surrounded by trenches. After spreading from an emitter as far as the trenches, current flows inwards of the substrate in the direction of depth of the trenches. The resistance in the interior of trenches is therefore not spread resistance but resistance to normal linear current.) is 50 V, and the voltage applied across the region through which current spreads is also 50 V. The field intensity at this time is $5\times10^4$ V/cm because a voltage of 50 V is impressed across a distance of 10 μm in the resistance interior of the trenches. However, the field intensity in the spread-resistance region becomes $5\times10^5$ V/cm because a voltage of 50 V is applied across a distance of approximately 1 μm in a radial direction in this region. As a result, field breakdown is possibly caused in the spread-resistance region. The possibility of field breakdown in the region of current spread, i.e., in the spread-resistance region, thus increases in cases in which the distance margin between trenches and emitters is made greater than the 0.2 μm to 0.5 μm length.

Furthermore, a third drawback is that a method in which a trenches are formed for each individual emitter imposes a limit upon the reduction of space between emitters, i.e., limits miniaturization. In other words, in cases in which a trench depth of 10 μm or more is required, attempting to produce an emitter pitch on the order of 2 μm or less causes the trench width to fall below 1 μm and the aspect ratio of trenches to exceed 10. This causes difficulties when burying trenches with a buried layer.

Here, a method is considered in which the distance between emitters is reduced by forming a plurality of emitters in an area surrounded by trenches. However, mere forming a plurality of emitters within an area surrounded by trenches results in greater current spread from each individual emitter than for a case in which each individual emitter is separated by trenches. This results in the problem that high withstand-voltage cannot be obtained because, as explained hereinabove, withstand-voltage is essentially determined by the conditions in the region directly below an emitter.

SUMMARY OF THE INVENTION

It is an object of the present invention to provide a method of forming resistance for preventing discharge breakdown despite miniaturization of the emitters of the field-emission cold cathode, reduction of the distance between emitters, or reduction of the distance between emitters and trenches;

It is another object of the present invention to provide a field-emission cold cathode wherein the value of the resistance for preventing discharge breakdown is highly controllable; and moreover, wherein the application of high voltage to this resistance during normal operation can be suppressed.

The field-emission cold cathode of the present invention is provided with: emitters that have acute tips and that are formed on a conductive substrate, and a gate electrode that has openings over the emitters; and comprises trenches formed inwards of the substrate from the upper surface of the conductive substrate, and n-type regions formed on the conductive substrate surrounded by the trenches and having lower resistivity than the conductive substrate, the emitters being formed on the n-type regions.

By thus forming n-type regions having lower resistivity than the substrate on the surface of substrate regions surrounded by trenches, voltage impressed across a gate and emitter when discharge occurs is applied across the entire substrate that includes the n-type region, thereby enabling prevention of most of the applied voltage locally built up at only the contact portions directly below emitters.

It is effective to form the n-type regions in the regions of current spread in which current spreads into the substrate from emitters when a discharge occurs between the gate and emitters.

The spread resistance of a region of current spread can be made the same level as, or lower than, the resistance of other resistance regions by forming an n-type region of low resistance on the upper surface of a resistance region directly below an emitter where current spreads from the emitter. As a result, a substantially uniform field intensity distribution can be obtained in a resistance region surrounded by trenches, independent on the distance between the emitter and trenches. A cold cathode element can thus be formed in which there are no differences in withstand-voltage resulting from differences in the distance between an emitter and trenches.

In the case of a resistance of the 20-$\mu$m resistance length of a resistance region surrounded by trenches, resistance in a current spread region, which was 50 kΩ/emitter in the preceding technology, can be dramatically reduced to 3 kΩ/emitter by forming resistance regions as described hereinabove. In this way, the field centralization in a current spread region can be relaxed. This effect is not due simply to the reduction of contact resistance by implanting impurity atoms into the contact portion, but to the reduction of the resistance of an entire spread region.

In the field-emission cold cathode of the present invention, an n-type region can be formed over the entire surface of the conductive substrate surrounded by the trenches. Alternatively, a plurality of emitters can be formed on an n-type region formed on each of the regions surrounded by trenches.

If an n-type region is not present as in a cold cathode element of the prior art, formation of a plurality of emitters on a substrate region surrounded by trenches gives rise to a high electric field in the current spread regions directly below emitters as described hereinabove. This condition in turn gives rise to field breakdown or avalanche breakdown. In a cold cathode element of the present invention, in contrast, formation of a low-resistance n-type region in the current spread region of the plurality of emitters allows to prevent the generation of high voltage in a short length directly below the emitters, even where a plurality of emitters are formed in a substrate region surrounded by trenches. Accordingly, there is no reduction in the withstand-voltage in the element according to the present invention.

In the field-emission cold cathode of the present invention, p-type regions may be formed at the base of trenches in the conductive substrate. These p-type regions serve as current-limiting regions that allow effective lengthening of the resistance length of the substrate regions surrounded by trenches to greater than the actual depth of the trenches.

In the field-emission cold cathode of the present invention, the resistivity of the region from the upper surface of the conductive substrate to the depth to which the trenches are formed may be determined different from the resistivity of other regions of the substrate.

By doping n-type impurity to the region ranging from the upper surface of the substrate to the depth to which the trenches is formed at a higher concentrate than in other regions of the silicon substrate, it is possible to form a resistance region having lower resistance that passes a high saturation current during operation at pinch resistance. Conversely, if an n-type resistance layer is formed that has lower impurity concentration than the concentration in other regions of the substrate, a desired resistance value can be obtained by increasing the area of the substrate region surrounded by trenches. In this case, an increase in the number of emitters is possible.

The method of producing a field-emission cold cathode of the present invention is for a field-emission ilk cold cathode having emitters formed on a conductive substrate and a gate electrode formed so as to have openings above the emitters; and comprises the steps of: forming a first insulator film on the upper surface of an n-type silicon substrate; forming a mask having openings in a trench formation region surrounding an emitter formation region on the first insulator film and patterning the first insulator film; forming trenches in the silicon substrate using the first insulator film as a mask; burying a buried film made up of an insulative film inside the trenches; removing the buried film and the first insulator film until the surface of the silicon substrate is exposed; doping n-type impurity atoms of a desired concentration onto the exposed silicon substrate to a depth corresponding to the spread region of current flowing into the substrate from an emitter, thereby forming an n-type region having a higher conductivity than the silicon substrate; forming a second insulator film and gate electrode film on the n-type region; forming openings in the emitter formation region of the gate electrode film and second insulator film; and forming emitters on the n-type region of the openings.

In this way, n-type regions of low resistance can be formed in the regions of current spread in regions surrounded by trenches.

The above and other objects, features, and advantages of the present invention will become apparent from the following description referring to the accompanying drawings which illustrate examples of the present invention.

BRIEF DESCRIPTION OF THE DRAWINGS

FIG. 13A–13D shows sectional views of the manufacturing processes of the sixth embodiment of the present invention.

DETAILED DESCRIPTION OF THE PREFERRED EMBODIMENTS

Figure 4:
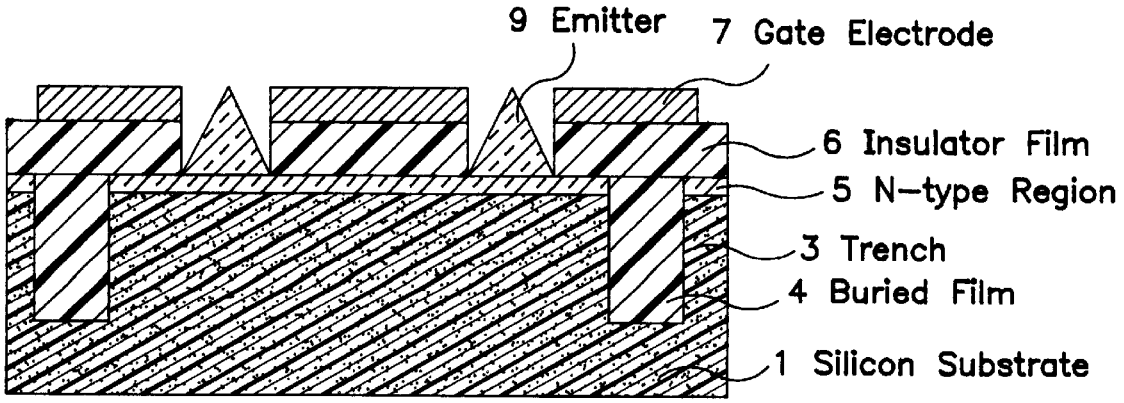
FIG. 4 is a sectional view of the first embodiment of the present invention.

Embodiments of the present invention are next explained with reference to the accompanying figures. FIG. 4 is a sectional view showing an embodiment of the present invention. The field-emission cold cathode of this embodiment is provided with: n-type silicon substrate 1; trenches 3 formed selectively in the direction of depth from the upper surface of silicon substrate 1; buried film 4 buried in trenches 3; n-type region 5 formed on the upper surface of silicon substrate 1; emitters 9 formed on the n-type region 5; and insulator film 6 and gate electrode film 7 formed so as to surround emitters 9.

Figure 5:
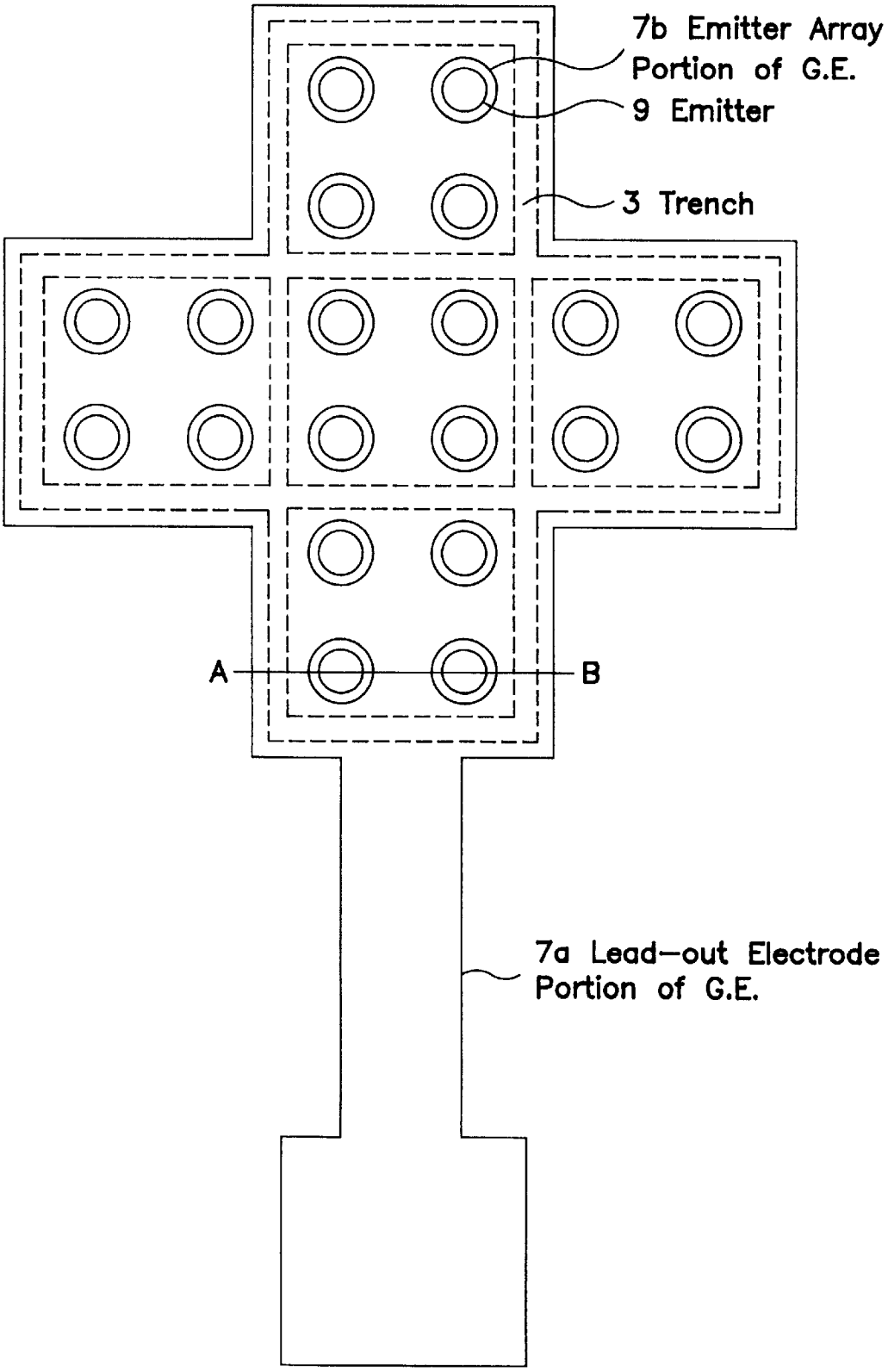
FIG. 5 is a plan view of the first embodiment of the present invention.
Figure 6A:
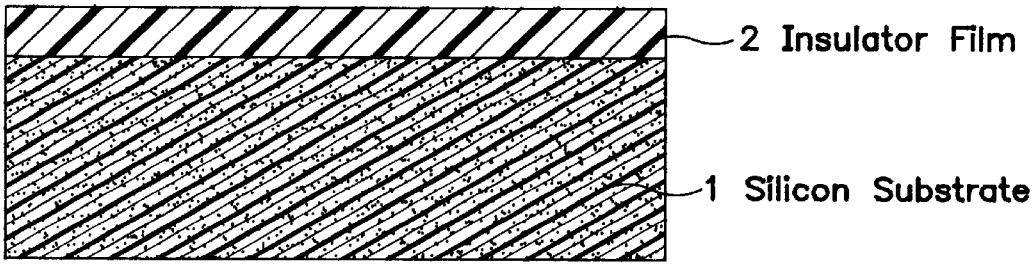
FIG. 6A–6D show shows sectional views of the manufacturing processes of the first embodiment of the present invention.
Figure 6B:
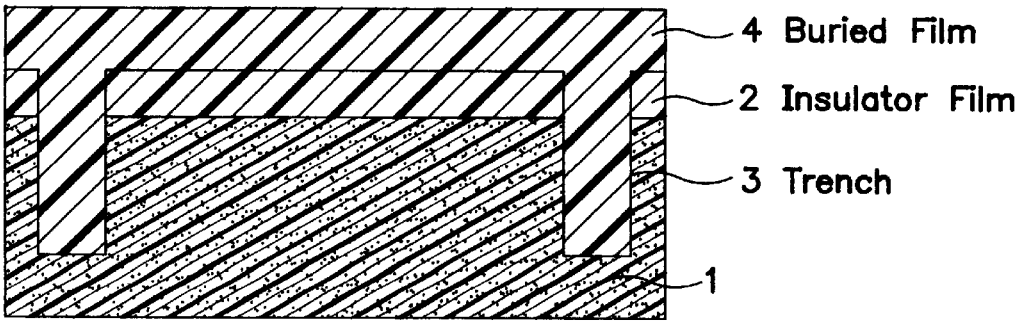
Figure 6C:
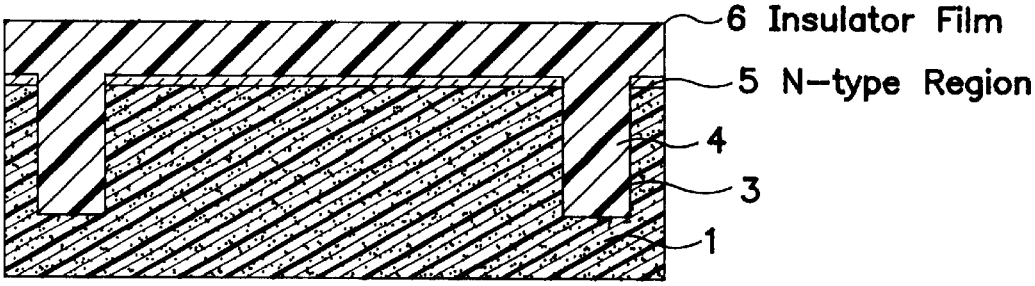
Figure 6D:
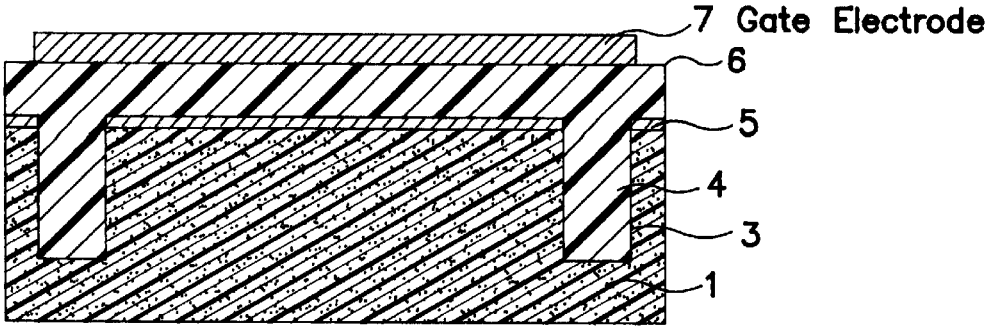
Figure 7A:
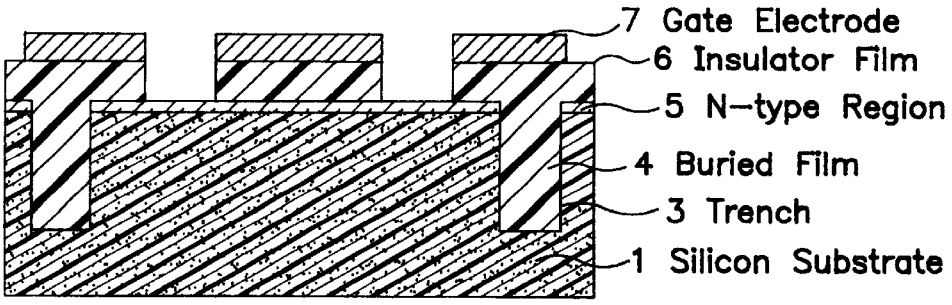
FIG. 7A–7D show shows sectional view of the manufacturing processes of the first embodiment of the present invention.
Figure 7B:
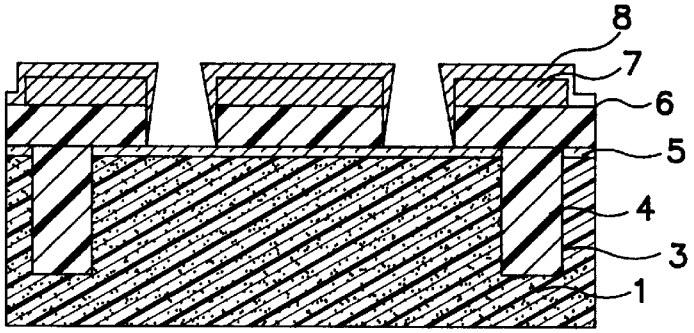
Figure 7C:
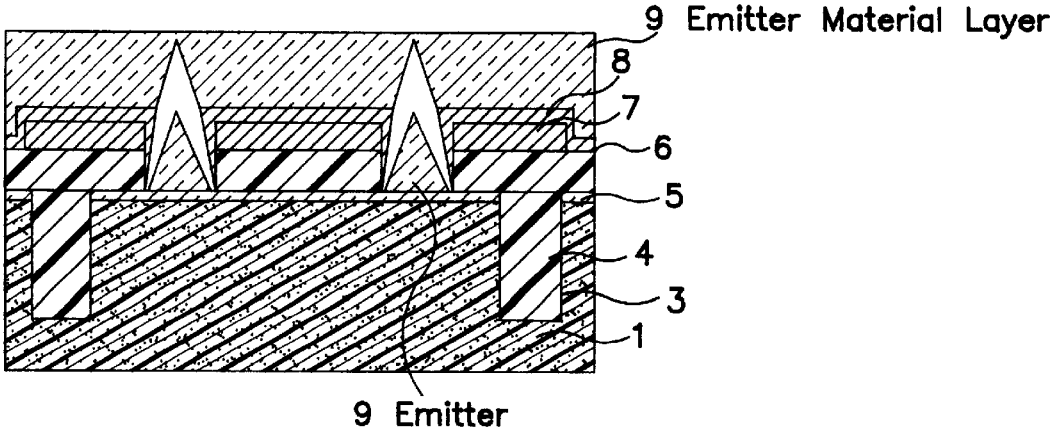
Figure 7D:
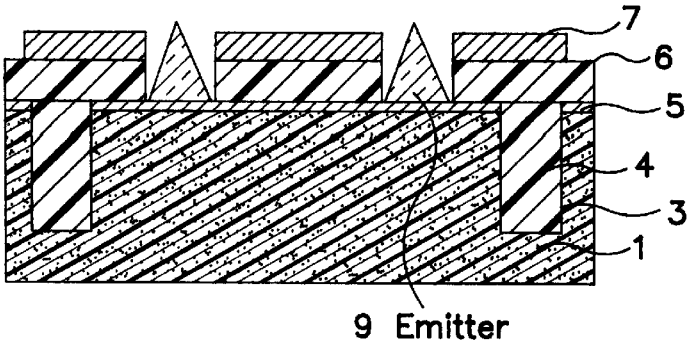

FIG. 5 is a plan view showing the embodiment of FIG. 4, FIG. 4 being a section taken at line A–B of FIG. 5. Referring to FIG. 5, gate electrode film 7 is made up of lead-out electrode portion 7*a* and emitter array portion 7*b*. Openings are formed in the emitter formation region of emitter array portion 7*b*, and emitters 9 are formed within these openings. Emitters 9 are configured to be blocks of a plurality of emitters (4 emitters in this figure) and the blocks of emitters are separated from each other by trenches 3.

In this embodiment, the regions of silicon substrate 1 that are surrounded by trenches 3 function as resistance regions, and the embodiment is thus constructed such that a plurality of emitters 9 surrounded by trenches are connected in parallel to one resistance region. The pitch between the emitters within the trenches (within the region enclosed by the trenches) can be set independently of the width of the trenches, and as a result, this embodiment can be applied to miniaturization on the submicron level or greater. In addition, forming n-type region 5 on the upper surface of the resistance region and forming emitters 9 on top of n-type region 5 can prevent the local build-up of the resistance of the region directly below emitters in the current-spread region. In this way, a reduction of the resistance in the current-spread regions can be attained. Width and depth of the n-type regions of from 0.2 $\mu$m to 0.5 $\mu$m or more is effective for controlling the resistance value of the current-spread regions. Field concentrations in the current-spread regions directly below the emitters can thus be prevented. Consequently, the electric field during a discharge operates over the entire resistance region surrounded by trenches. This prevents a current increase due to field concentration, thereby allowing breakdown-free element to be designed.

Figure 14:
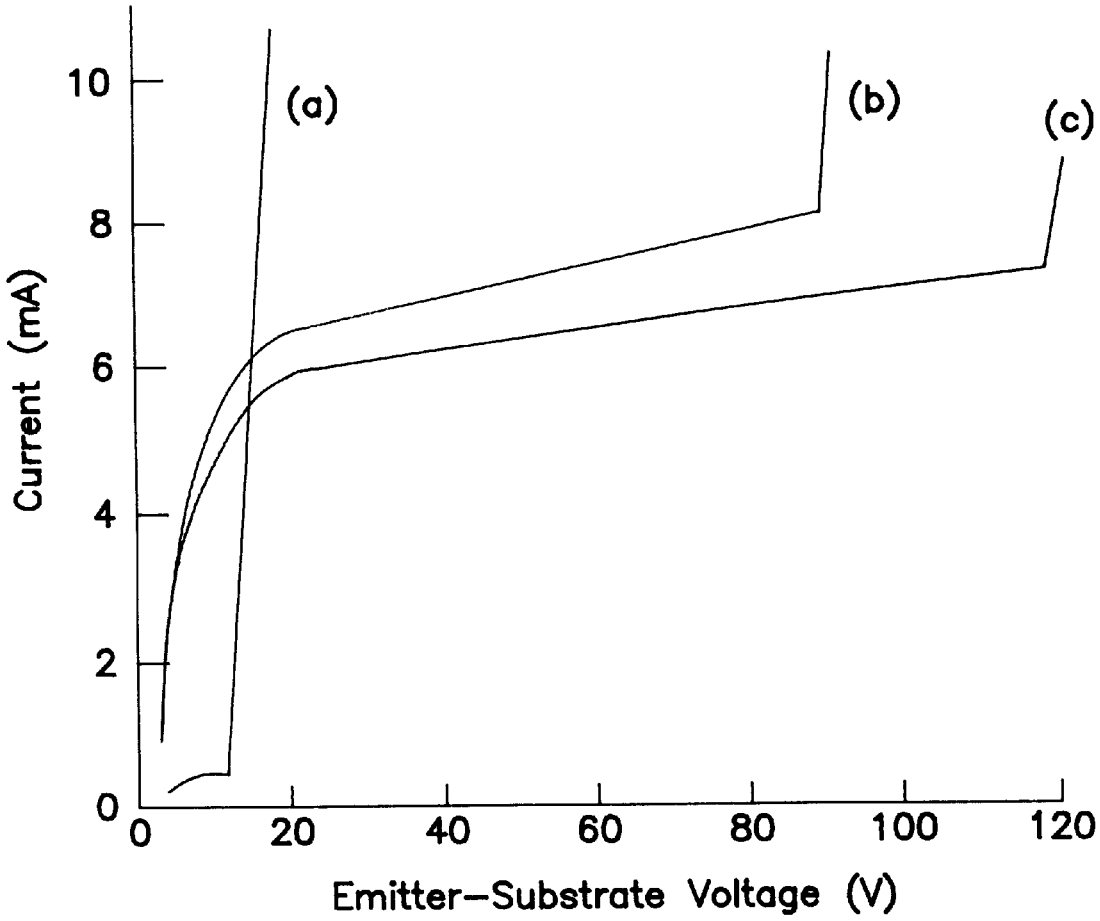
FIG. 14 shows the resistivity characteristic of the embodiments of the present invention.

If discharge occurs at a certain emitter, the potential of the upper portion of the resistance region to which the emitter belongs may approach the gate potential, and the potential of other resistance regions will remain low at several volts or less. The potential beyond the trenches of the resistance region underlying the emitter where discharge occurs can therefore be fixed at a low potential, whereby a depletion layer suddenly extends from inside the trenches. The resistance characteristic thus exhibits a pinch resistance characteristic during discharges. Results obtained through experimentation show that this pinch resistance characteristic depends on the width of the trenches. FIG. 14 shows the IV [Current/Voltage] characteristic of resistance, with the current value flowing in the resistance region plotted against the voltage across the emitter and silicon substrate for cases in which (a) n-type region 5 is absent and trench width is 2 $\mu$m; (b) n-type region 5 is present and trench width is 0.5 $\mu$m; and (c) n-type region 5 is present and trench width is 2 $\mu$m.

Figure 1:
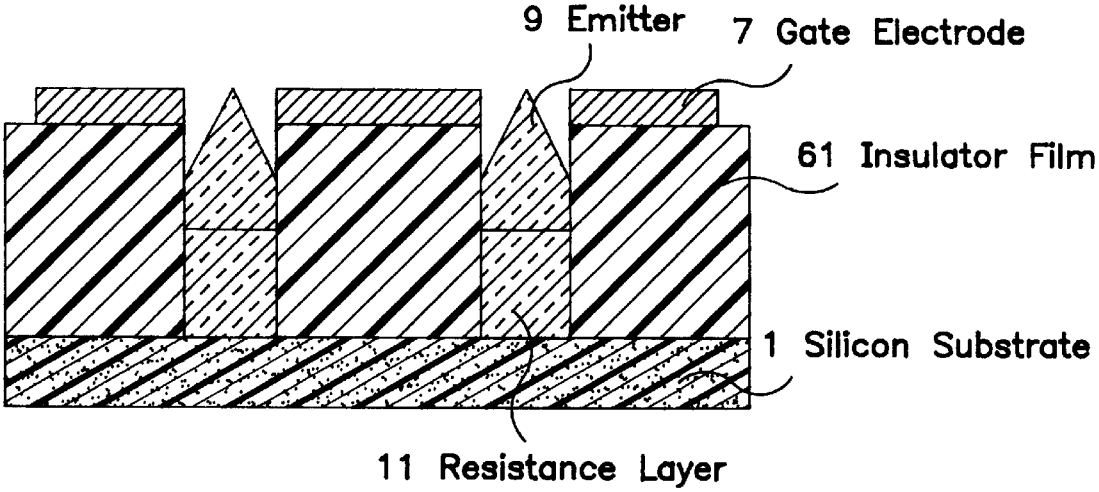
FIG. 1 PRIOR ART
FIG. 1 is a sectional view of an example of the prior art.
Figure 2:
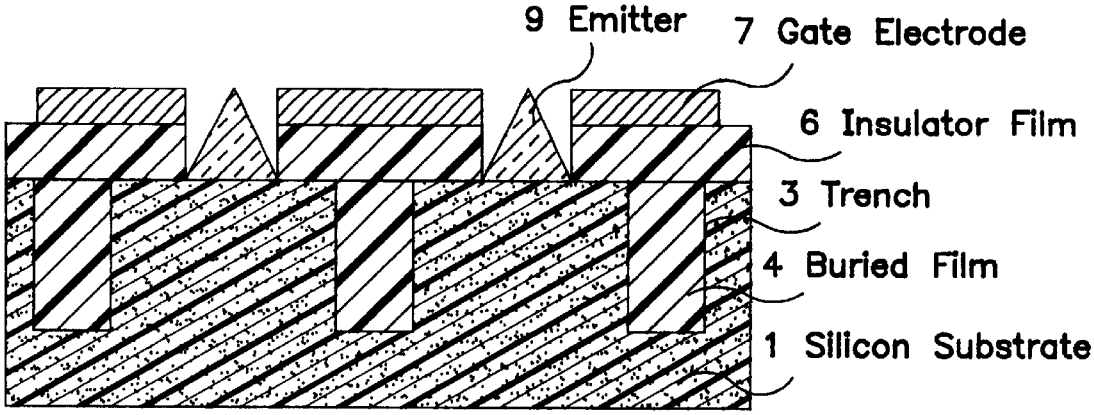
FIG. 2 is a sectional view of an example of the preceding technology.
Figure 3:
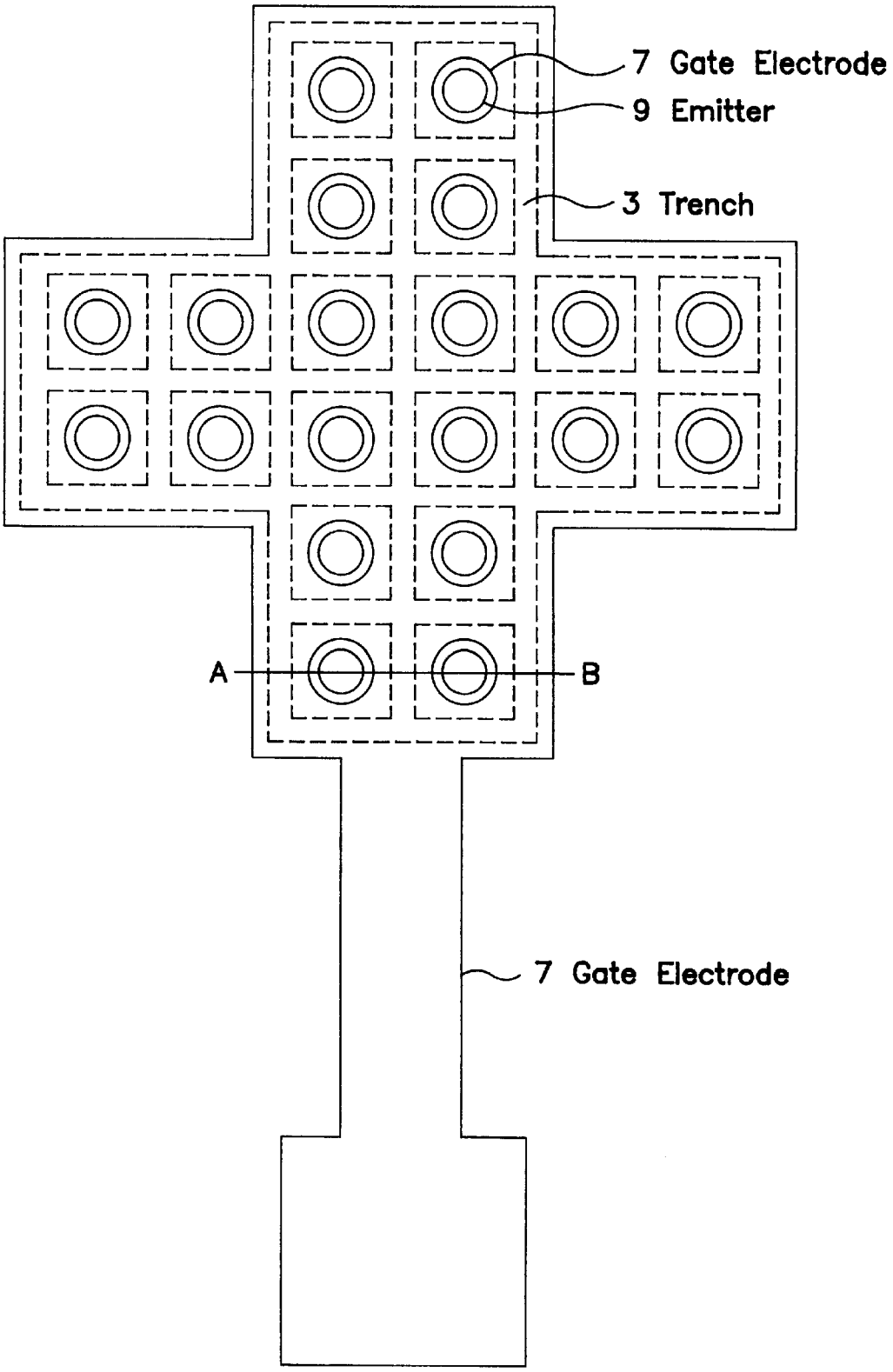
FIG. 3 is a plan view of the example shown in FIG. 2.

In the case (a) in which an n-type region is absent, the withstand-voltage drops when the field-emission cold cathode element has a construction in which there is long distance between emitters and trenches such as in FIG. 2. In this case, the current is determined by the width of the current spread region directly below an emitter as described hereinabove. Accordingly, the current increases at low voltage.

In contrast, in cases (b) and (c) in which an n-type region is formed, high withstand-voltage can be obtained, because the withstand-voltage is determined by the resistance length (depth of trenches). As for dependence on the width of the trenches, it is believed that the spread of a depletion layer is gradual and uniform with wider trenches. Accordingly, the withstand-voltage is higher with wide trenches in (c) than in (b). In the present invention , the resistance characteristic can thus be modified by taking the construction of trenches into account.

FIG. 6 (*a*)–(*d*) and FIG. 7 (*a*)–(*d*) are sectional views showing the manufacturing processes of the first embodiment of the present invention. First, as shown in FIG. 6(*a*), an oxide film having a film thickness of approximately 500 nm is formed as insulator film 2 by a thermal oxidation method or a CVD method on the surface of n-type silicon substrate 1 having a impurity concentration of approximately $10^{15}$ $cm^{-3}$ or more. Next, a resist is patterned (not shown in the figure) to form a mask having openings with a width on the order of approximately 0.5 $\mu$m–2 $\mu$m, on insulator film 2 in the trench formation regions surrounding the emitter formation regions, following which insulator film 2 is patterned by an anisotropic etching method. After further removal of resist, trenches 3 are formed at a prescribed depth of, for example 10 $\mu$m, by anisotropic etching of silicon substrate 1 using insulator film 2 as a mask, and, as shown in FIG. 6(*b*), buried film 4 made up of an insulative film is formed to bury trenches 3. This buried film is formed, after growing a reflowable film of, for example, BPSG film (boron phospho-silicate glass film) to a film thickness thicker than the width of trenches 3 by a low-pressure CVD method, by carrying out a heat treatment at approximately 1000° C. to level the buried film.

In addition, the side walls of trenches 3 are preferably treated by thermal oxidation to form an oxide film before growing the BPSG film to suppress diffusion of the impurity atoms from the BPSG film. A method of depositing an insulator film such as a nitride film is also effective.

As shown in FIG. 6(*c*), n-type region 5 is formed by etching away buried film 4 and insulator film 2 deposited outside trenches 3 by a plasma etching method using a gas such as $CHF_3$, and doping n-type impurity atoms such as phosphorus atoms by an ion implantation method to a concentration of $10^{17}$ $cm^{-3}$ or more to a depth of 0.5 $\mu$m. Next, insulator film 6 of, for example, an oxide film, is deposited to a thickness of 500 nm by, for example, a CVD method. Next, as shown in FIG. 6(*d*), a gate electrode film made up of a metal film of, for example, Tungsten or Molybdenum, is formed by a sputtering method to a thickness of approximately 200 nm, following which gate electrode film 7 is patterned using resist as a mask by a plasma etching method using a gas such as $SF_6$.

Next, as shown in FIG. 7(*a*), gate electrode film 7 and insulator film 6 in the emitter formation regions are successively etched in an etching gas using a resist as a mask, wherein gate electrode film 7 is etched by $SF_6$ and insulator film 6 is etched by, for example, $CHF_3$. In this way, openings that expose n-type region 5 is formed.

As shown in FIG. 7(*b*), sacrificial layer 8 made up of aluminum is deposited to a thickness of approximately 100 nm by an electron beam evaporation method from a oblique direction tilted a prescribed angle from a perpendicular direction. Due to the deposition from a oblique direction in this process, the sacrificial layer does not form on the exposed n-type region that is the emitter formation region but rather, forms on the side walls of insulator film 6 and the side wall and upper surface of gate electrode film 7.

Next, as shown in FIG. 7(*c*), emitter material layer 9*a* of, for example, Molybdenum, is deposited by an electron beam evaporation method from a perpendicular direction. In this process, emitter material layer 9*a* is grown on sacrificial layer 8 and n-type region 5, the shape on n-type region 5 being cones, thereby forming emitters 9. Sacrificial layer 8 is next removed by etching in a solution of, for example, phosphoric acid. Emitter material layer 9*a* on sacrificial layer 8 is thus lifted off to form the field-emission cold cathode shown in FIG. 7(*d*). In this way, n-type regions 5 are formed in the current spread regions on a silicon substrate divided by trenches 3 that are buried by an insulator. A plurality of emitters 9 are formed on low-resistance n-type regions 5. Since this construction of the field-emission element does not cause deterioration in withstand-voltage, margins between emitters can thus be reduced. Since this reduction of margins can be designed without regard to trench width, control of the pinch resistance characteristic, which depends on trench width as described in the foregoing explanation, can be achieved without impeding the reduction of margins.

Although this example is intended to form a plurality of emitters 9 on a resistance region surrounded by trenches (substrate region surrounded by trenches) and to reduce the emitter pitch, this construction is also effective when forming emitters at a large pitch. For example, in a construction in which a single emitter is formed on a resistance region surrounded by trenches with a large margin with the trenches, forming an n-type region is again effective for forming a field-emission cold cathode without degrading withstand-voltage.

While a BPSG film was used as the insulation film for burying trenches in the method described hereinabove, the invention need not be limited to a BPSG film. For example, the trenches may also be buried by a non-doped oxide film formed by low-pressure growth, or the trenches may be closed by thermal oxidation. Alternatively, good results may be obtained by burying the trenches by first forming an insulator film on the side walls of the trenches, burying the trenches with a polycrystalline silicon film, and then forming an insulator film on the surface of the polycrystalline silicon film.

Figure 8:
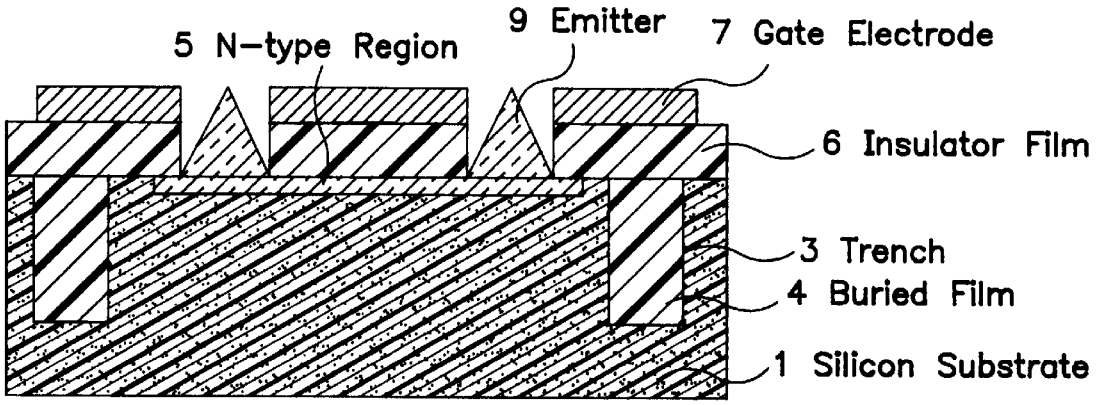
FIG. 8 is a sectional view showing the second embodiment of the present invention.

Explanation is next presented regarding the second embodiment of the present invention. FIG. 8 is a sectional view showing the second embodiment of the present invention. As in the first embodiment, the constituent elements of this cold cathode element include: trenches 3 selectively formed in the direction of depth from the upper surface of n-type silicon substrate 1 and filled in by buried film 4; n-type region 5 formed on the upper surface of silicon substrate 1; emitters 9 formed on n-type region 5; and insulator film 6 and gate electrode film formed so as to surround emitters 9. In this embodiment, n-type regions 5 are formed directly below emitters, and although the resistance of the current spread regions is reduced, the construction is such that the n-type regions do not contact the trenches. This embodiment can thus relax the intensity of fields in the vicinity of the contact surface between this n-type region 5 and trenches 3 when discharge occurs between the emitters and gate electrode and a depletion layer extends from trench side walls. In this way, this embodiment can improve the reliability of maintaining withstand-voltage.

Figure 9:
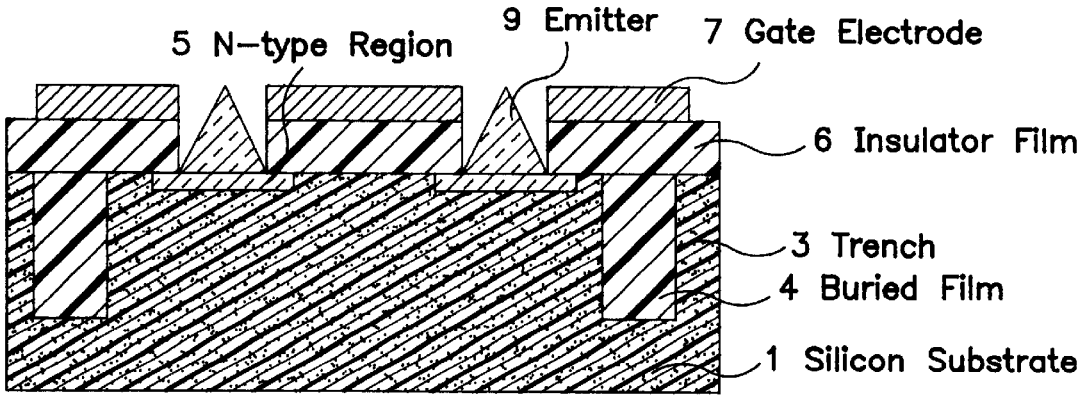
FIG. 9 is a sectional view showing the third embodiment of the present invention.

FIG. 9 is a sectional view showing the third embodiment of the present invention. In contrast with the second embodiment, which is a construction in which emitters 9 formed in a region surrounded by trenches are all connected by n-type region 5, in the third embodiment, n-type region 5 of larger area than the base area of an emitter is formed for each individual emitter.

Unlike the semiconductor process of the prior art in which an n-type low-resistance region was formed only in the area of contact between an emitter and the substrate, an n-type region is formed in the spread current region. The resistance of the n-type region is designed so that the resistance of the n-type region to the spread-current from the emitter is lower than the resistance of the resistance region enclosed by the trenches to the spread-current of concern, when a discharge occurs. By virtue of this construction of the cathode element, it can be avoided that a major part of the voltage applied between the gate and emitter is concentratively impressed at the contact portion between emitter and substrate when discharging occurs. Withstand-voltage can therefore be ensured without forming n-type region 5 over the entire region surrounded by trenches.

This method has the advantage that processing steps can be simplified because the n-type regions can be formed through self-alignment by injecting n-type impurity atoms from the openings of the emitter formation region in insulator film 6.

Figure 10:
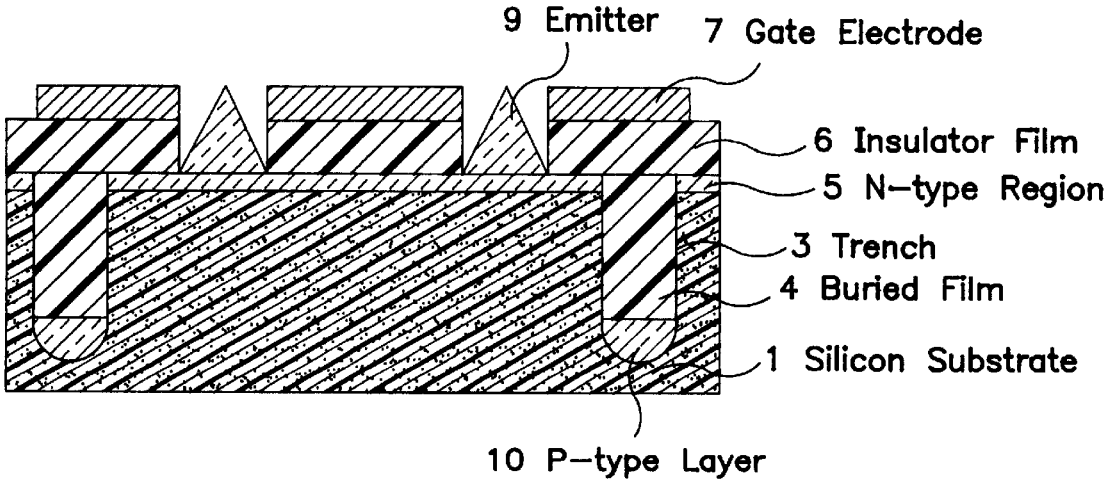
FIG. 10 is a sectional view showing the fourth embodiment of the present invention.

FIG. 10 is a sectional view showing the fourth embodiment of the present invention. In this embodiment, p-type layer 10 having an impurity concentration of, for example, $10^{17}$ $cm^{-3}$, is formed at the bottom of trenches 3 of the cold cathode of the first embodiment. This p-type layer 10 can be formed by selectively doping boron by, for example, ion implantation, following the formation of trenches 3. This p-type layer 10 serves as a current-limiting region, and can increase the effective resistance length of the substrate region (resistance region) surrounded by trenches to longer than the actual depth of the trenches. In addition, it is possible to control the field distribution within substrate regions surrounded by trenches by effecting thermal diffusion to make the width of p-type layer 10 wider than the width of the trenches. Moreover, while the shape of n-type region 5 may be formed as in the first embodiment, this embodiment is not limited to the shape of the first embodiment, and the n-type regions employed in the second or third embodiment may also be applied to obtain the same effects without problem.

Figure 11:
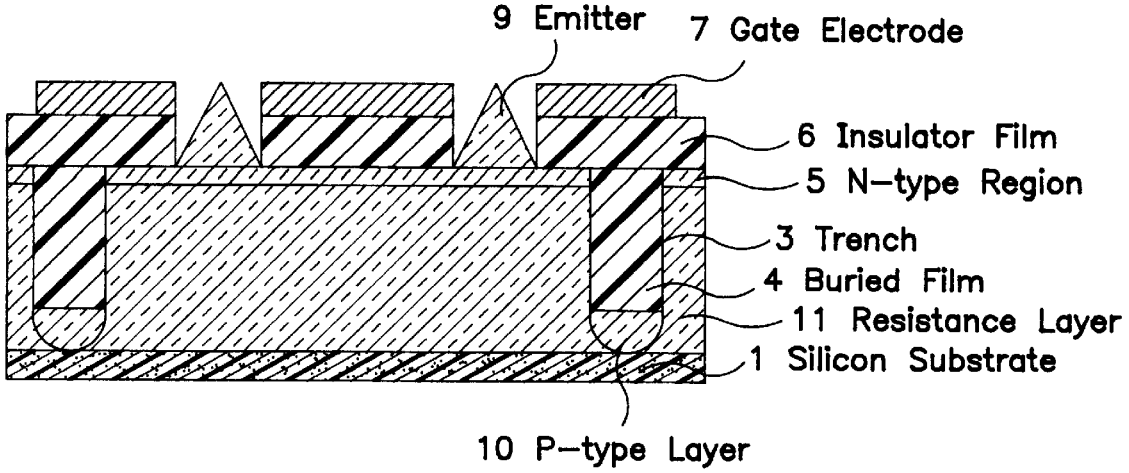
FIG. 11 is a sectional view showing the fifth embodiment of the present invention.
Figure 12A:
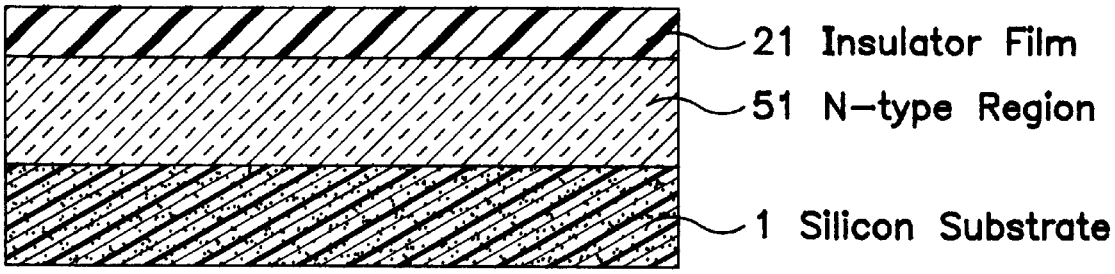
FIG. 12A–12D shows sectional views of the manufacturing processes of the sixth embodiment of the present invention.
Figure 12B:
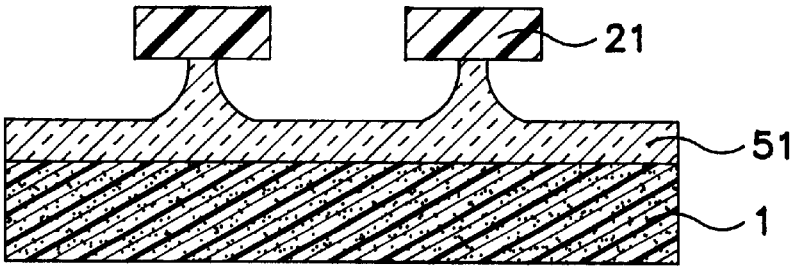
Figure 12C:
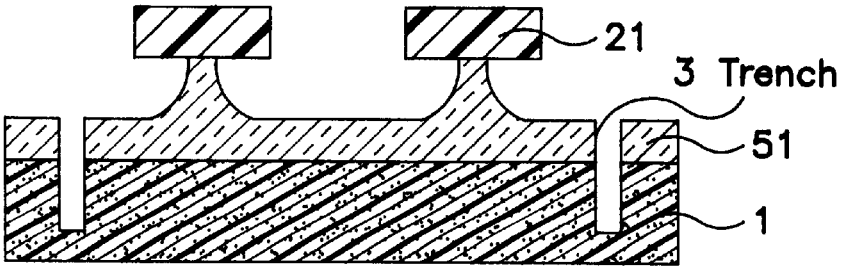
Figure 12D:
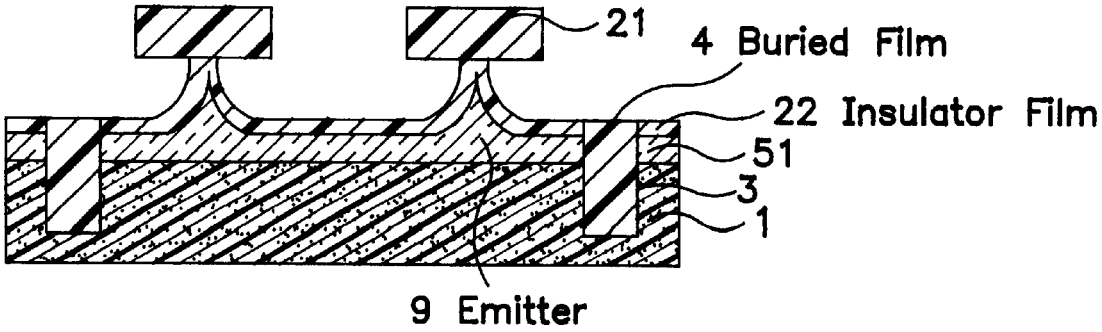

Explanation is next presented regarding the fifth embodiment of the present invention. FIG. 11 is a sectional view showing the fifth embodiment of the present invention. The cold cathode of this embodiment is manufactured by the following processes. First, an n-type resistance layer 11 having concentration of, for example, $10^{16}$ $cm^{-3}$, is formed by epitaxial growth on an n-type silicon substrate 1 having concentration of $10^{15}$ $cm^{-3}$, following which trenches 3 that divide the resistance layer 11 are formed. Next, p-type layer 10 is formed, and trenches 3 are then buried with buried film 4. N-type regions 5 are then formed on the upper surface of resistance layer 11, following which emitters 9 are formed on n-type regions 5 in the openings of selectively formed gate electrode film 7 and insulator film 6.

Doping an n-type impurity at a concentration higher than the silicon substrate in this way enables formation of a resistance region of lower resistance having a high saturation current when operating at pinch resistance. Conversely, when forming an n-type resistance region of lower concentration than the substrate concentration, a desired resistance can be obtained and the number of emitters can be increased, by increasing the area of a substrate region surrounded by trenches. In this case as well, the resistance value, withstand-voltage, and number of emitters within a substrate region surrounded by trenches can all be easily controlled by forming n-type region 5 in the current spread region. This embodiment is a method of introducing resistance layer 11 grown by an epitaxial growth method into the cold cathode of the fourth embodiment. This embodiment, however, may also be applied to other embodiments to obtain the same results.

Figure 13A:
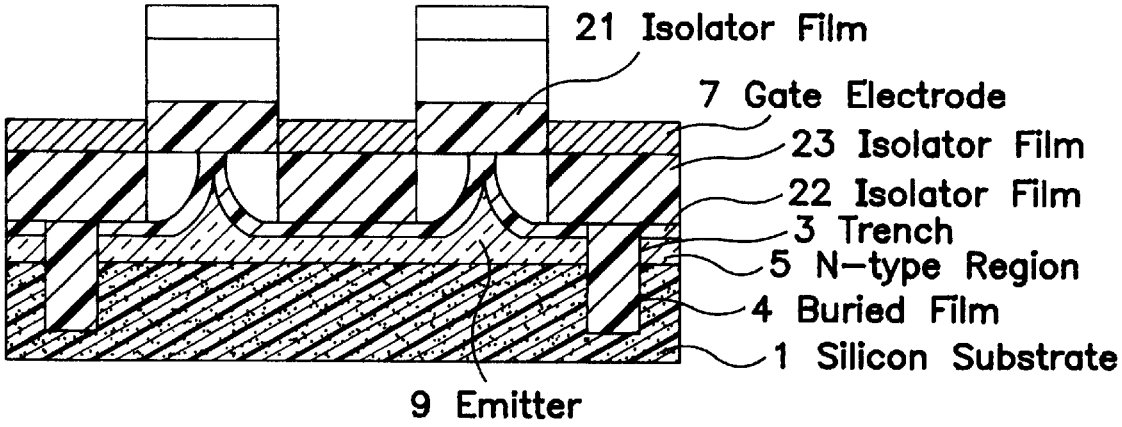
Figure 13B:
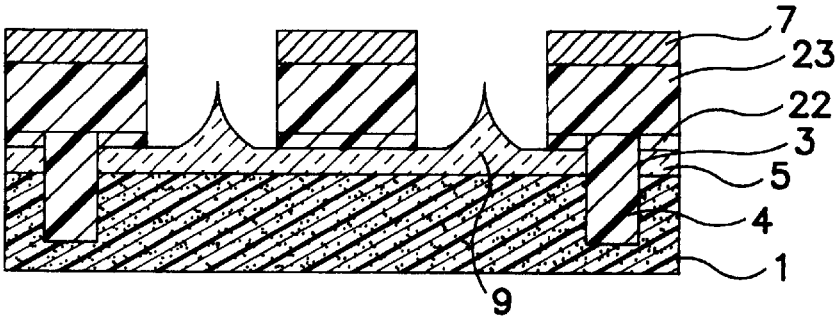
Figure 13C:
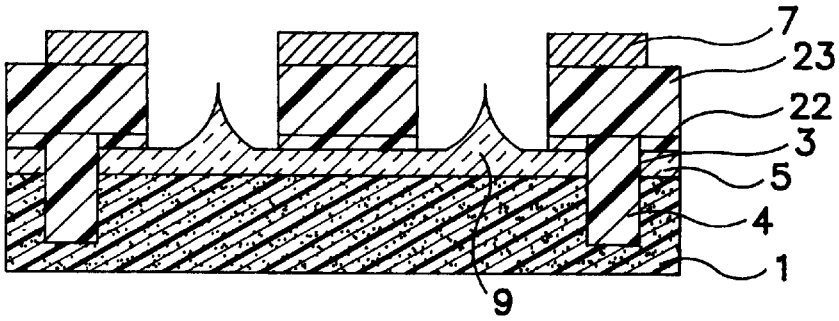

Explanation is next presented regarding the sixth embodiment. FIG. 12 (*a*)–(*d*) and FIG. 13 (*a*)–(*c*) are sectional views showing the manufacturing processes of the sixth embodiment of the present invention. In FIG. 12(*a*), n-type region 51 having a concentration of approximately $10^{17}$ $cm^{-3}$ or more is formed on an n-type silicon substrate 1 having an impurity concentration of approximately $10^{15}$ $cm^{-3}$ by an epitaxial growth method to a thickness of 2 $\mu$m; following which insulator film 21 composed of, for example, oxide film having a thickness of approximately 500 nm, is formed by a CVD method. Next, as shown in FIG. 12(*b*), using resist (not shown) as a mask, areas of insulator film 21 other than the emitter formation region are removed by anisotropic etching using, for example, $CHF_3$, following which, using insulator film 21 as a mask, the exposed n-type region 51 is further treated by isotropic etching using, for example, $SF_6$, thereby processing n-type region 51 into a protruding shape. Next, as shown in FIG. 12(*c*), using resist as a mask, trenches 3 are formed to a depth of approximately 10 $\mu$m in n-type region 51 and silicon substrate 1. In FIG. 12(*d*), the interior of these trenches is filled by buried film 4 of, for example, BPSG film, and the surface of n-type region 51 is subjected to thermal oxidation to a depth of approximately 200 nm to form insulator film 22. In this process, the protruding n-type region 51 is also oxidized to form emitters 9 with acute tips. Next, as shown in FIG. 13(*a*), insulator film 23 composed of, for example, an oxide film, is deposited to a thickness of approximately 300 nm by an electron beam evaporation method in a perpendicular direction with respect to the substrate, following which gate electrode film 7 made up of, for example, Tungsten or Molybdenum is deposited to a film thickness of approximately 200 nm. Next, as shown in FIG. 13(*b*), insulator film 21 composed of oxide film and insulator film 22 that overlies emitters 9 are etched away using hydrofluoric acid. Insulator film 23 deposited over insulator film 21 is also etched away in this process, and in addition, gate electrode film 7 is lifted off to expose emitters 9. As shown in FIG. 13(*c*), using a resist as a mask, gate electrode film 7 is patterned using, for example, $SF_6$, whereby the field-emission cold cathode is formed. Here, emitters 9 may be made a still lower resistance by carrying out, for example, ion implantation, or alternatively, the cone portions may be coated with a metal film to produce lower resistance, or a reduction of the work function of the surface material may be contrived. The previous embodiments were examples of emitters formed from metal film, but this embodiment provides an example of emitters that are formed by processing the silicon substrate. With this type of silicon emitter as well, the n-type region 5 that includes emitters 9 on a region surrounded by trenches is formed on an upper surface between trenches, and as a result, the spread current region can be modified to a lower resistance, and a plurality of emitters can be formed.

Forming an n-type region in the region of current spread on a substrate region surrounded by trenches, and making the region of current spread a lower resistance to suppress the concentration of fields at the contact portion between an emitter and substrate provide the following effects:

1) Resistance can be formed having stable and high withstand-voltage wherein variation in withstand-voltage resulting from differences in the distance between emitters and trenches is eliminated. As a result, micro-emitters having gate diameters on the submicron level can be formed, thereby enabling miniaturization of a cold cathode element; trench depth suitable for the resistance length necessary for high withstand-voltage need not be increased to large dimensions such as 5 to 10 $\mu$m; and the problem of breakdown caused by the large aspect ratio of emitters or resistance can be eliminated. In addition, the invention has technical merit for the miniaturization of emitters.

2) A plurality of emitters can be formed in a resistance region surrounded by trenches, and as a result, trenches need not be formed in all of the spaces between emitters, and the spacing between the plurality of emitters formed in each of the regions surrounded by trenches can be reduced; thereby enabling a further miniaturization of a cold cathode element.

3) The invention provides an improvement in the control of both the withstand-voltage of a cold cathode element as well as the resistance value of current spread regions. As a result, control of the withstand-voltage and resistance value corresponding to the voltage settings of the cold cathode element can be made using degrees of freedom other than the trench depth, independently of emitter size and emitter pitch, thereby allowing increased degree of freedom in the design of a cold cathode element.

4) Finally, because miniaturization is enabled as described hereinabove, increase in floating capacitance can be suppressed, whereby high-speed operation of a cold cathode can be improved. Moreover, because emitters can be protected when operating at high voltage, the invention also allows an improvement in reliability.

It is to be understood, however, that although the characteristics and advantages of the present invention have been set forth in the foregoing description, the disclosure is illustrative only, and changes may be made in the shape, size, and arrangement of the parts within the scope of the appended claims.

What is claimed is,:

1. A field-emission cold cathode, comprising:

emitters that have acute tips and that are formed on a conductive substrate;

a gate electrode that has openings over said emitters;

trenches formed inside said conductive substrate from the upper surface of said conductive substrate; and n-type regions of lower resistivity than said conductive substrate that are formed on said conductive substrate surrounded by said trenches; wherein said emitters are formed on said n-type regions.

2. A field-emission cold cathode according to claim 1 wherein said n-type regions are formed in the regions of current spread in which current spreads into the interior of said substrate from emitters when a discharge occurs between said gate and said emitters.

3. A field-emission cold cathode according to claim 2 wherein said n-type regions are formed on the entire surface of said conductive substrate that is surrounded by said trenches.

4. A field-emission cold cathode according to claim 2, wherein said n-type regions are formed on the surface of said conductive substrate that is surrounded by said trenches, so that said n-type region does not contact said trench, and that the area of said n-type region is at least larger than a base area of an emitter.

5. A field-emission cold cathode according to claim 2 wherein a plurality of said emitters are formed on an n-type regions formed in each of regions surrounded by said trenches.

6. A field-emission cold cathode according to claim 2 wherein a p-type region is formed on a base portion of said trenches in said conductive substrate.

7. A manufacturing method for a field-emission cold cathode provided with emitters that are formed on a conductive substrate, and a gate electrode that has openings over said emitters; comprising the steps of:

forming a first insulation film on a surface of an n-type silicon substrate;

forming a mask having openings in a trench formation region surrounding an emitter formation region on said first insulation film and patterning said first insulation film;

forming trenches in said silicon substrate using said first insulation film as a mask;

burying a buried film made up of an insulative film inside said trenches;

removing said buried film and said first insulation film until the surface of said silicon substrate is exposed;

doping n-type impurity atoms of a prescribed concentration onto the exposed silicon substrate to a depth corresponding to a region of spreading current that flows into the substrate from an emitter, in order to form an n-type region having a higher conductivity than said silicon substrate;

forming a second insulation film and a gate electrode film on said n-type region;

forming openings in the emitter formation region of said gate electrode film and second insulation film; and forming emitters on the n-type region of the openings.

* * * * *